US007837135B2

(12) United States Patent
Nolte et al.

(10) Patent No.: US 7,837,135 B2
(45) Date of Patent: Nov. 23, 2010

(54) APPLICATION ELEMENT FOR A ROTARY SPRAYER AND ASSOCIATED OPERATING METHOD

(75) Inventors: Hans-Jurgen Nolte, Besigheim (DE); Harald Gummlich, Ludwigsburg (DE)

(73) Assignee: Durr Systems GmbH, Plymouth, MI (US)

( * ) Notice: Subject to any disclaimer, the term of this patent is extended or adjusted under 35 U.S.C. 154(b) by 191 days.

(21) Appl. No.: 12/300,272

(22) PCT Filed: May 7, 2007

(86) PCT No.: PCT/EP2007/004018

§ 371 (c)(1),
(2), (4) Date: Nov. 10, 2008

(87) PCT Pub. No.: WO2007/131661
PCT Pub. Date: Nov. 22, 2007

(65) Prior Publication Data

US 2009/0212122 A1 Aug. 27, 2009

(30) Foreign Application Priority Data

May 11, 2006 (DE) ..... 10 2006 022 057

(51) Int. Cl.

| | |
|---|---|
| ***F23D 11/32*** | (2006.01) |
| *B05B 17/04* | (2006.01) |
| *B05B 3/02* | (2006.01) |
| *B05B 3/10* | (2006.01) |
| *B05B 3/00* | (2006.01) |
| *B05B 1/34* | (2006.01) |
| *B05B 7/06* | (2006.01) |
| *B05B 5/025* | (2006.01) |
| *B05B 5/04* | (2006.01) |
| *B05D 1/36* | (2006.01) |
| *B05D 3/00* | (2006.01) |
| *B05D 1/02* | (2006.01) |

(52) U.S. Cl. ..... 239/700; 239/701; 239/702; 239/703; 239/7; 239/223; 239/225.1; 239/214; 239/224; 239/380; 239/222.11; 118/314; 118/626; 118/629; 118/621; 427/421.1; 427/484; 427/2.3; 427/409

(58) Field of Classification Search ..... 239/7, 239/703, 223, 225.1, 214, 700, 380, 106, 239/255, 263, 701, 702, 580, 222.11, 112, 239/504; 118/314, 626, 629, 621; 427/421.1, 427/484, 2.3, 409

See application file for complete search history.

(56) References Cited

U.S. PATENT DOCUMENTS 2,893,894 A * 7/1959 Ransburg ..... 427/484

(Continued)

FOREIGN PATENT DOCUMENTS

DE 93 15 890 U1 5/1994

(Continued)

OTHER PUBLICATIONS

English language abstract of JP 2006181556.

(Continued)

*Primary Examiner*—Len Tran
*Assistant Examiner*—Steven M Cernoch
(74) *Attorney, Agent, or Firm*—Rader Fishman Grauer

(57) ABSTRACT

The invention relates to an application element (1) for a rotary sprayer, in particular in the form of a bell-shaped plate or a rotary disc, with an overflow surface (8) which, during the coating operation, rotates together with the application element (1) and is overflowed by a coating agent to be applied, and with a surface layer which is located on the overflow surface (8) and on which a thin coating agent film forms with a certain film thickness during operation, wherein boundary surface friction acts between the coating agent film and the surface layer. It is proposed that the surface layer reduces the boundary surface friction between the coating agent film and the overflow surface (8). Furthermore, the invention comprises an associated operating method.

23 Claims, 1 Drawing Sheet

U.S. PATENT DOCUMENTS

Figure 1:
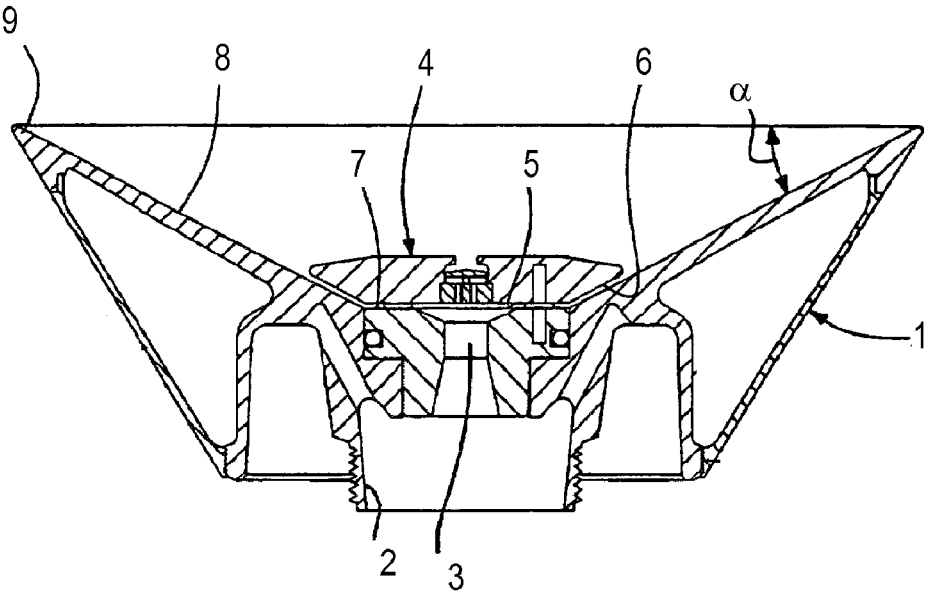

| | | | | | |
|---|---|---|---|---|---|
| 2,986,338 | A * | 5/1961 | Foster | 239/222 |
| 2,989,241 | A * | 6/1961 | Badger | 239/703 |
| 4,148,932 | A * | 4/1979 | Tada et al. | 239/3 |
| 4,402,991 | A * | 9/1983 | Meisner | 239/3 |
| 4,429,833 | A * | 2/1984 | Meisner et al. | 239/224 |
| 4,458,844 | A * | 7/1984 | Mitsui | 239/703 |
| 4,518,119 | A * | 5/1985 | Vetter | 239/223 |
| 4,605,168 | A * | 8/1986 | Tachi et al. | 239/112 |
| 4,784,332 | A * | 11/1988 | Takeuchi et al. | 239/703 |
| 4,927,081 | A * | 5/1990 | Kwok et al. | 239/223 |
| 5,934,574 | A * | 8/1999 | van der Steur | 239/690.1 |
| 6,030,656 | A * | 2/2000 | Hostettler et al. | 427/2.3 |
| 6,076,751 | A * | 6/2000 | Austin et al. | 239/700 |
| 6,189,804 | B1 * | 2/2001 | Vetter et al. | 239/7 |
| 6,360,962 | B2 * | 3/2002 | Vetter et al. | 239/106 |
| 6,623,561 | B2 * | 9/2003 | Vetter et al. | 118/314 |
| RE38,526 | E * | 6/2004 | Hansinger et al. | 239/3 |
| 6,896,211 | B2 * | 5/2005 | Seitz | 239/700 |
| 7,017,835 | B2 * | 3/2006 | Vetter et al. | 239/380 |
| 2003/0080221 | A1 * | 5/2003 | Seitz | 239/700 |
| 2005/0136190 | A1 * | 6/2005 | Tani et al. | 427/421.1 |
| 2006/0138250 | A1 * | 6/2006 | Vetter et al. | 239/225.1 |

FOREIGN PATENT DOCUMENTS

| | | | |
|---|---|---|---|
| DE | 44 39 924 | A1 | 5/1996 |
| DE | 101 12 854 | A1 | 10/2001 |
| EP | 0 087 836 | A1 | 9/1983 |
| EP | 0 951 942 | A2 | 10/1999 |
| GB | 726559 | A | 3/1955 |
| GB | 2 294 214 | A | 4/1996 |
| JP | 61 035868 | A | 2/1986 |
| JP | 08155348 | | 6/1996 |
| JP | 2006 181556 | A | 7/2006 |
| WO | WO-99/49983 | A | 10/1999 |
| WO | WO-2006/049341 | A1 | 5/2006 |

OTHER PUBLICATIONS

Abstract of GB 2,361,440 (corresponding to DE 101 12 854).
English language abstract of JP 61035868.
English language translation of DE 44 39 924.
English language translation of DE 93 15 890.
Title sheet of US 4,525,417 (corresponding to EP 0 087 836).
Title sheet of US 6,360,962 (corresponding to EP 0 951 942).
International Search Report of PCT/EP/2007004018 dated Aug. 17, 2007.

* cited by examiner

APPLICATION ELEMENT FOR A ROTARY SPRAYER AND ASSOCIATED OPERATING METHOD

CROSS REFERENCE TO RELATED APPLICATIONS

This application is a National Stage of PCT/EP2007/004018, with a filing date of May 7, 2007, which claims priority to DE 102006022057.9, filed May 11, 2006, which are hereby incorporated by reference in their entirety.

The invention relates to an application element for a rotary atomizer, in particular in the form of a bell-shaped plate or a rotary disk, and an associated operating method according to the subsidiary claims.

For the serial painting of components, for example, motor vehicle bodies, it is known to use high-speed rotary atomizers, which comprise a rapidly rotating bell-shaped plate as the application element. The paint to be applied is normally fed to the rotating bell-shaped plate by means of a central paint pipe and then flows to the bell-shaped plate via an overflow surface to an outer-lying annular peripheral spraying edge, where the paint is flung off by centrifugal force.

EP 0 951 942 A2 discloses a bell-shaped plate of this type which is provided specifically for the application of effect paints which contain solid effect particles, also known as effect pigments or 'flakes'.

However, in the use of conventional bell-shaped plates for applying effect paints, unwanted deviations in the colour tones and in the colour tone effect often occur when compared with conventional compressed air spraying, which are caused by the different material treatment in the spraying processes. In particular, during film formation and paint film flow in the region of the overflow surfaces, large frictional and shear forces arise, and these can damage the light-reflecting effect particles of the paint mixture. Damage to the finished coated bodies can occur during the surface finishing process (e.g. dirt inclusions, surface defects), during shell construction (surface and substrate defects) and during the further production steps, for example, final assembly, or such damage may become apparent during production. Such damage must be rectified. These subsequent local corrections are usually carried out with an air spraying device. Therefore, when using the combination of automatic paint spraying by means of a high-speed rotary atomizer together with manual correction using an air spraying device, despite the different application techniques, the visual appearance must be equivalent for both application methods.

The reasons for this mixed operation lie therein that existing paints (formulations) should not be altered. Manual painting jobs are also still carried out in the paint line (between the automated cells/zones) where, for example, interior painting is carried out with an air spraying device. In addition, retooling or automation of existing paint lines takes place in stages, also resulting in mixed operation.

In order to prevent colour tone deviations resulting from the different application techniques, the recipes for the paint materials used are therefore adapted in preparation such that equivalent results are produced following their different applications. The pigment corrections that are required as a result represent a significant additional effort in terms of materials and organisation. In particular, the colour tone matching capability must be monitored on changes of batch in the paint supply. Furthermore, the repair paints necessary for manual corrections involve small quantities with a limited shelf life and quantity requirements that are difficult to calculate, so that the costs per liter are significantly higher than the material costs for normal automatic paint application with a high speed rotary atomizer. In addition, the paint required for manual correction cannot be taken from the normal production distribution pipes, which means that suitable repair paints must be kept available for all production paints and, for mixing, must be kept in motion with stirrers.

A disadvantage of the aforementioned bell-shaped plate disclosed in EP 0 951 942 A2 is that the required colour tone is achieved by a high rotary speed and this has a negative effect on efficiency. Additionally, this involves higher deflection air values.

DE 101 12 854 A1 discloses a conventional bell-shaped plate for a high speed rotary atomizer, wherein the overflow surface is coated with a surface layer in order to improve the abrasion performance of the overflow surface and thereby to improve the service life of the bell-shaped plate. However, this known bell-shaped plate with a coated overflow surface also has the aforementioned disadvantages when applying effect paints.

JP 08155348 also discloses a bell-shaped plate, the overflow surface of which is coated with a surface layer of fluororesin which is intended to improve the spraying performance. This bell-shaped plate also suffers from the aforementioned disadvantages when applying effect paints.

DE 93 15 890 U1 discloses rotary atomizers wherein the coating powder to be applied is charged by triboelectric means through friction against a plastics surface. For this purpose, the overflow surface of the bell-shaped plate has a surface layer of polytetrafluoroethylene (PTFE) which, due to the friction between the coating powder flowing over the overflow surface and the surface layer made from PTFE, provides for good triboelectric charging of the coating powder. However, this known bell-shaped plate is also suitable only to a limited extent for the application of effect paints, since therein the aforementioned disadvantages arise.

DE 44 39 924 A1 discloses covering paint bells with an abrasion-proof and low friction carbon-containing coating, which also improves the paint finish, since the wettability properties of the surface of the paint bell are improved. Paint bells coated in this manner also suffer from the aforementioned problems in the application of effect paints.

Finally, EP 0 087 836 A1 discloses the reduction of surface friction on solid surfaces by friction-reducing coatings which, for example, have a scale-shaped crystal structure or contain nitrides.

It is therefore an object of the invention to provide a bell-shaped plate which is as well suited as possible to the application of effect paints with minimal damage to effect particles.

This problem is solved with an application element and a corresponding method of operation according to the subsidiary claims.

The invention is based on the newly acquired technical knowledge that the aforementioned problems arising in the application of effect paint are caused by the boundary surface friction between the paint film on the overflow surface of the bell-shaped plate and the overflow surface itself.

The inventors discovered that the boundary surface friction between the paint film and the overflow surface leads to large frictional and shear forces in the paint film, which deforms the thin, flat effect particles of the effect paint and damages their surface, and this leads to the aforementioned unwanted colour tone deviations.

They also found that the boundary surface friction between the paint film and the overflow surface leads to relatively thick paint films, so that the thin, flat effect particles (flakes) stand upright within the paint film. The boundary surface friction can also lead to movement of the effect particles, particularly where they have a length of, for example, 100 μm and a thickness of approximately 1 μm. The effect particles can become damaged due to surface abrasion and fracture, which impairs the desired colour tone (i.e. the visual effect of the applied paint). Reducing the surface friction between the paint film and the overflow surface, according to the invention, however, enables the damage to the effect particles from frictional and shear forces to be prevented.

In contrast to the aforementioned coated bell-shaped plates of the prior art, the surface coating according to the invention therefore produces a targeted reduction of boundary surface friction, whereas the surface coating with known bell-shaped plates is only intended to increase abrasion resistance, or is required for triboelectric charging.

In a variant of the invention, the boundary surface friction between the paint film and the overflow surface is reduced in that the surface roughness of the surface layer on the overflow surface is reduced. Preferably, the surface roughness of the surface layer of the overflow surface is less than the thickness of the coating agent film. For example, the surface roughness of the surface layer of the overflow surface may be less than 200 μm, 100 μm, 50 μm, 10 um or even 5 μm.

In another variant of the invention, the boundary surface friction between the paint film and the surface layer of the overflow surface is reduced in that the overflow surface has a friction-reducing texture, and this can be a so-called riblet structure or a so-called artificial shark skin, which is known per se and therefore does not need to be further described. A friction-reducing shark skin film of this type is obtainable, for example, from the 3M Company under the name "Scotchcal Marine Drag Reduction Tape".

As mentioned above, the coating material (the material to be sprayed) is an effect paint including flat, solid effect particles (flakes) with a defined particle length and forms a paint film on the surface layer of the overflow surface, the boundary surface friction being so greatly reduced that the paint film has a thickness which is smaller than the particle length of the effect particles. This offers the advantage that the individual particles of the effect paint cannot stand upright within the paint film and they therefore flow with an ordered spatial orientation over the overflow surface. Therefore, the paint film on the overflow surface has a thickness in operation which is preferably less than 200 μm, 100 μm, 50 μm, 10 μm or even 5 μm.

Preferably, the surface layer on the overflow surface at least partially consists of a nitride, wherein, for example, titanium nitride, chromium nitride, titanium carbon nitride, zirconium nitride, tungsten carbon nitride, and aluminium titanium nitride are suitable as materials for the surface layer of the overflow surface. However, the possibility exists within the context of the invention that the surface layer on the overflow surface at least partially consists of glass, ceramic material, metal or nanoparticles. However, all chemically inert, mechanically stable and well adhering materials are essentially suitable for the friction-reducing surface layer.

It is also noteworthy that the friction-reducing surface layer is preferably locally limited to application onto the whole of the overflow surface and/or other paint flow surfaces. However, as an alternative, the possibility also exists that the friction-reducing surface layer is limited to regions of the overflow surface which are subjected to large centrifugal forces. The further possibility exists that the whole rotating application element is coated with a friction-reducing surface layer.

Furthermore, the surface layer of the overflow surface is preferably more abrasion resistant and/or harder than the uncoated overflow surface, in order to improve the abrasion properties of the overflow surface and thereby to improve the service life of the application element. The surface layer of the overflow surface therefore preferably has a Vickers hardness of more than 500 HV, 1000 HV, 1500 HV, 2000 HV or even over 3000 HV.

It should also be mentioned that the surface layer of the overflow surface preferably consists of a different material than the overflow surface situated thereunder.

As an alternative, however, the possibility also exists that the surface layer of the overflow surface is made from the same material as the overflow surface situated thereunder. In this variant, the border surface friction can be reduced, for example, with a suitable surface texture of the surface layer.

For example, the surface layer of the overflow surface can comprise a film applied to the overflow surface, wherein this may be a shark skin film which is used in aircraft construction to reduce frictional resistance, and was mentioned above.

It is clear from the above description that the application element according to the invention is preferably a bell-shaped plate for a high-speed rotary atomizer. However, the invention is not restricted, with regard to the type of application element, to bell-shaped plates, but includes, for example, rotary disks for disk atomizers. Rotary disks of this type and the associated disk atomizers are also disclosed, for example, in Pavel Svejda: "Moderne Lackiertechnik, Prozesse und Applikationsverfahren", Vincentz publishing, 2003, pages 75 ff.

The invention relates to the application element according to the invention described above not only as a single component, but also a rotary atomizer with an application element of this type and a paint application machine, in particular a multi-axis paint robot with a rotary atomizer of this type.

Finally, the invention also relates to a corresponding method of operation for a rotary atomizer of this type wherein the boundary surface friction between the coating agent film on the overflow surface and the overflow surface itself is specifically reduced with a friction-reducing surface layer.

The surface friction is preferably reduced with the operating method according to the invention to such an extent that the thickness of the paint film on the overflow surface decreases until the film thickness is less than the particle length of the effect particles (the flakes, to be distinguished from pigments), such that the effect particles are not able to stand upright within the paint layer.

The invention therefore offers the advantage that an effect paint can be automatically applied by a rotary atomizer without special paints being necessary, without their effectiveness being worsened, and without the air usage being increased by greater deflection air levels, so that the colour tone result can be matched to the quality of a compressed air spray coating using the same paint material and without correcting the paint recipe.

Figure 2:
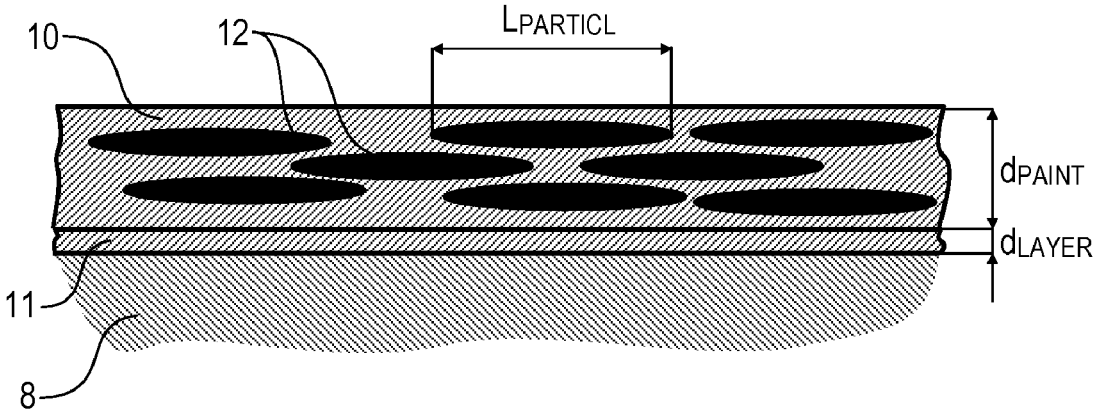

Other advantageous embodiments of the invention are disclosed in the subclaims or are described in the following description of a preferred embodiment of the invention making reference to the drawings, in which:

FIG. 1 shows a cross-section through a bell-shaped plate according to the invention for applying an effect paint, and FIG. 2 shows a greatly enlarged cross-sectional view of the overflow surface of the bell-shaped plate of FIG. 1.

The drawing in FIG. 1 shows a bell-shaped plate 1 for a high-speed rotary atomizer for the application of effect paint.

The construction and functioning of the bell-shaped plate 1 is largely in accordance with the prior art and is described in EP 0 951 942 A2, so that the content of that document in its entirety can be considered to be part of the present description concerning the construction and functioning of the bell-shaped plate 1.

In order to fasten the bell-shaped plate 1 to a bell-shaped plate shaft of a high-speed rotary atomizer, the bell-shaped plate 1 has a fastening hub 2 which is provided with an external thread which is screwed into a corresponding internal thread of the bell-shaped plate shaft.

Feeding of the effect paint to the bell-shaped plate 1 takes place through the fastening hub 2 and a central opening 3 in the bell-shaped plate 1.

Situated at the outlet orifice of the central opening 3 on the front face side is a deflection member 4 which has a centrally arranged and radially extending rear surface 5 and an outer, conically extending rear surface 6. The two rear surfaces 5, 6 of the deflection member comprise a border surface of a gap, which is formed on the opposing side of a region 7 of an otherwise conically extending overflow surface 8. The overflow surface 8 encloses, together with the front surface of the bell-shaped plate 1, an almost constant angle $\alpha$ and leads to an annular peripheral spraying edge 9.

The effect paint is fed axially to the bell-shaped plate 1, that is, via the fastening hub 2 and then passes through the central opening 3 in the bell-shaped plate 1. The deflection member 4 then deflects the effect paint in a radial direction, so that the effect paint flows over the overflow surface 8 and is finally flung off at the spraying edge 9.

The inventive special feature of the bell-shaped plate 1 is apparent from the cross-sectional view in FIG. 2, which shows the overflow surface 8 with a paint film 10 situated thereon and a friction-reducing surface layer 11 situated therebetween. It is also apparent from the cross-sectional representation that the paint film 10 includes numerous long, flat effect particles 12 with a defined particle length $L_{PARTICLE}$.

The friction-reducing surface layer 11 on the overflow surface 8 reduces the boundary surface friction between the paint film 10 and the surface layer 11 or the overflow surface 8 to such an extent that damage to the effect particles caused by abrasion and fractures is prevented, in order thereby to prevent consequential colour tone deviations compared to other spraying methods, and to avoid any adaptation costs arising therefrom.

It is also apparent from the cross-sectional view that the friction-reducing surface layer 11 has a layer thickness $d_{LAYER}$, which is significantly less than the film thickness $d_{PAINT}$ of the paint layer 10.

For example, the particle size $L_{PARTICLE}$ may lie in the range 10 μm to 40 μm, whereas the film thickness $d_{PAINT}$ may lie, for example, in the range of 5 μm to 20 μm. The layer thickness $d_{LAYER}$ of the friction-reducing surface layer 11 may lie in the range of 1 μm to 4 μm. However, the invention is not restricted to the above values, but may also be realised with other values of the particle size $L_{PARTICLE}$, film thickness $d_{PAINT}$ and layer thickness $d_{LAYER}$.

It is also noteworthy that the friction-reducing surface layer 11 in this embodiment is made from titanium nitride and reduces the boundary surface friction between the paint layer 10 and the overflow surface 8 by a factor of 4.

The invention is not restricted to the above described preferred embodiment. Rather, a number of variants and deviations is possible, which also make use of the inventive concept and therefore fall within the protective scope.

REFERENCE SIGNS

1 Bell-shaped plate
2 Fastening hub
3 Central opening
4 Deflection member
5 Radial rear surface of deflection member
6 Conical rear surface of deflection member
7 Region of overflow surface
8 Overflow surface
9 Spraying edge
10 Paint layer
11 Surface layer
12 Effect particles

The invention claimed is:

1. An application element for a rotary atomizer comprising:
an overflow surface which, in a coating operation, rotates with the application element and over which a coating agent that is to be applied flows, and
a surface layer situated on the overflow surface, on which, in operation, a thin coating agent film with a generally defined film thickness forms,
wherein a boundary surface friction acts between the coating agent film and the surface layer,
the surface layer reduces the boundary surface friction between the coating agent film and the overflow surface,
the coating agent is a paint, which includes a plurality of generally flat, solid paint particles with a generally defined particle length and forms the coating agent film on the surface layer, and
the film thickness of the coating agent film on the surface layer of the overflow surface is less than the particle length of the paint particles.

2. The application element according to claim 1, wherein
the surface layer of the overflow surface comprises a specific surface roughness, and
the surface roughness of the surface layer of the overflow surface is less than the film thickness of the coating agent film.

3. The application element according to claim 2, wherein the surface roughness of the surface layer of the overflow surface is less than 200 μm, 50 μm, 10 μm or 5 μm.

4. The application element according to claim 1, wherein the surface layer of the overflow surface has a friction-reducing texture.

5. The application element according to claim 4, wherein the surface layer of the overflow surface has a riblet structure.

6. The application element according to claim 1, wherein the surface layer at least partially consists of a nitride.

7. The application element according to claim 6, wherein the surface layer comprises a material selected from the group consisting of:
a) titanium nitride,
b) chromium nitride,
c) titanium carbon nitride,
d) zirconium nitride,
e) tungsten carbon nitride,
f) aluminum titanium nitride.

8. The application element according to claim 1, wherein the surface layer comprises a material selected from the group consisting of:
a) glass,
b) ceramic material,
c) metal,
d) nanoparticles.

9. The application element according to claim 1, wherein the surface layer of the overflow surface is more abrasion-resistant than the uncoated overflow surface.

10. The application element according to claim 1, wherein the surface layer of the overflow surface is harder than the uncoated overflow surface.

11. The application element according to claim 1, wherein the surface layer has a Vickers hardness of more than 1000 HV, 1500 HV or 2000 HV.

12. The application element according to claim 1, wherein the surface layer of the overflow surface comprises a different material than the overflow surface situated thereunder.

13. The application element according to claim 1, wherein the surface layer of the overflow surface is made from the same material as the overflow surface situated thereunder.

14. The application element according to claim 1, wherein the surface layer of the overflow surface is a film applied to the overflow surface.

15. The application element according to claim 1 in the form of a bell-shaped plate.

16. The application element according to claim 1 in the form of a rotary disk.

17. A rotary atomizer comprising an application element according to claim 1.

18. A painting machine comprising a rotary atomizer according to claim 17.

19. A painting machine according to claim 18 in the form of a paint robot.

20. A method of operation for a rotary atomizer having a rotary application element, wherein a) a coating agent flows over an overflow surface on the rotating application element and forms a coating agent film on the overflow surface with a defined film thickness, b) the boundary surface friction between the coating agent film and the overflow surface is reduced by means of a friction-reducing surface layer on the overflow surface, c) the coating agent being a paint which includes solid, flat paint particles which have a defined particle length and forming a paint film with a defined film thickness on the surface layer of the overflow surface, d) the boundary surface friction between the surface layer of the overflow surface and the paint film is sufficiently small so that the film thickness of the paint film is smaller than the particle length of the paint particles.

21. The method of operation according to claim 20, wherein a) an effect paint which includes solid, flat paint particles is applied with the rotary atomizer, and b) following application of the effect paint by the rotary atomizer, no manual or automated correction of the effect paint applied is carried out.

22. The method of operation according to claim 20, wherein a) an effect paint which includes solid, flat paint particles is applied with the rotary atomizer, and b) the application of the effect paint by means of a rotary atomizer can be combined with other spraying methods such that, with regard to colour tone and colour tone effect, equivalent results can be obtained without adjusting the paint material.

23. Use of an application element according to claim 1 for applying an effect paint which includes solid, flat paint particles.

* * * * *